United States Patent [19]

Buchner

[11] Patent Number: 4,513,876

[45] Date of Patent: Apr. 30, 1985

[54] CONTAINER LID WITH AN OPENER DEVICE

[75] Inventor: Norbert Buchner, Winnenden, Fed. Rep. of Germany

[73] Assignee: Robert Bosch GmbH, Stuttgart, Fed. Rep. of Germany

[21] Appl. No.: 620,343

[22] Filed: Jun. 13, 1984

[30] Foreign Application Priority Data

Jun. 15, 1983 [DE] Fed. Rep. of Germany ..... 3321572

[51] Int. Cl.[3] ..... B65D 17/34

[52] U.S. Cl. ..... 220/270

[58] Field of Search ..... 220/260, 269–273, 220/359; 156/257

[56] References Cited

U.S. PATENT DOCUMENTS

| | | | |
|---|---|---|---|
| 4,267,937 | 5/1981 | Piltz et al. | 220/270 |
| 4,403,710 | 9/1983 | Hirota et al. | 220/270 |
| 4,428,494 | 1/1984 | Hirota et al. | 220/270 |
| 4,448,324 | 5/1984 | Jeppsson et al. | 220/270 |

*Primary Examiner*—George T. Hall

*Attorney, Agent, or Firm*—Edwin E. Greigg

[57] ABSTRACT

A lid for a packaging container including an easy opening tear-open part which is surrounded by a weakened line. The lid is molded from a compound material, which has an outer carrier layer of plastic, a middle barrier layer of metal foil and an inner heat-sealing layer of a thermoplastic material. In order to facilitate the initial tear of the tear-open part, the middle barrier layer is also thinned or ruptured at least in the starting segment in a location coinciding with the weakening line in the carrier layer.

18 Claims, 4 Drawing Figures

CONTAINER LID WITH AN OPENER DEVICE

BACKGROUND OF THE INVENTION

The invention is based on a container lid with an opening device. A lid of this kind known for instance from European Patent A-0004834 comprises a relatively thick, outer carrier layer of thermoplastic material and a thin, inner barrier layer of an aluminum/plastic laminate. To facilitate opening a container that is sealed with a lid of this kind, a weakening line i.e., a line of semiperforations, a fold or a score-line that weakens the material along the line is disposed in the carrier layer of the lid, surrounding a tear-open part.

Despite the weakened or even completely perforated carrier layer in the area of the tear-open part, very much greater force must be exerted to make the initial tear when tearing out the tear-open part from the container lid than to continue tearing open the part. Accordingly, it is desirable to have a container lid of the generic type described above that could be embodied such that easy initial tearing and continuation of the tear is attained.

OBJECT AND SUMMARY OF THE INVENTION

The container lid according to the invention has the advantage that despite the weakened metal barrier layer in the area where the tear is initiated, the tightness of the container is assured because the elasticity of the plastic does not undergo any damage during the process of weakening the barrier layer and because the inner sealing layer of plastic covers the weakened barrier layer, and the sealing layer itself.

As a result of the characteristics recited herein advantageous further embodiments of the container lid disclosed are attainable. The container lid can be produced in high quantity and in a simple manner in accordance with a method as recited herein.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
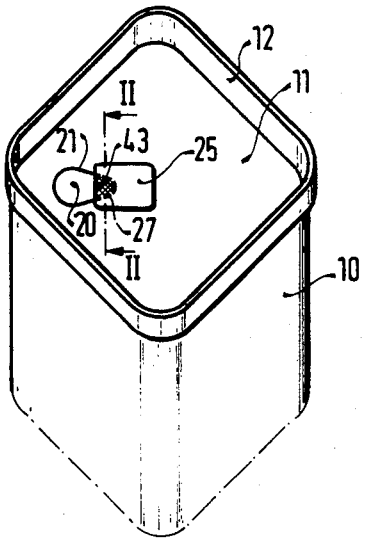
FIG. 1 shows the upper part of a container having a first exemplary embodiment of a lid, seen in a perspective view.

A packaging container having a body 10 made from a multi-layered packaging material is closed at its upper opening with a lid 11, which for removal of the contents has an easily operatable opening device. The basic outline of the body 10 and the lid 11 is in the form of a square with rounded corners. The lid 11 has a U-shaped rim fold 12, which grasps the opening rim of the body 10 and is heat sealed or welded thereto. It is formed by deep drawing or cupping.

For producing the lid 11, a multiple-layer compound material is used, which has an outer layer 14 of plastic, a middle layer 15 of metal, preferably aluminum, and an inner layer 16 of some heat-sealable plastic. The individual layers may be connected with one another by means of a coating glue. The outer layer 14 which forms the carrier layer lends the lid its rigidity and strength. The outer layer is approximately 100 to 400 μm, and preferably 200 μm, thick and is formed from a thermoplastic material such as polyvinyl chloride (PVC), polyester (PETP), polystyrene (PS), polycarbonate (PC) or the like. The middle layer 15, which contributes to a high degree of tightness and gas-proofness of the lid 11, comprises an aluminum or steel foil having a thickness of from 20 μm to 40 μm. The inner layer 16, which serves the purpose of heat-sealing or welding the top to the body 10 acts as a corrosion-resistant sealing layer and has a thickness of approximately 50 μm and is formed from polyethylene (PE), polypropylene (PP), polyvinylidene chloride (PVDC) or polyester (PETP).

Figure 3:
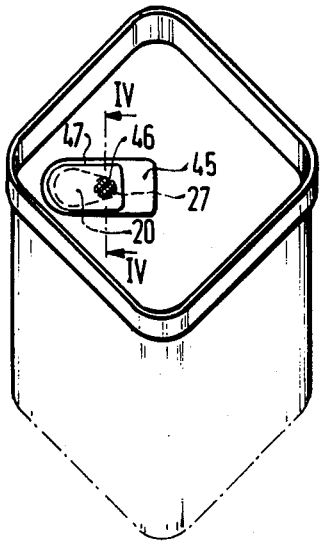
FIG. 3 shows the upper part of a container having a second exemplary embodiment of a lid, also seen in a perspective view.

The opening device in the lid 11 has a separable tear-open part 20, which is surrounded by a weakening line 21. The tear-open part 20 may have various shapes, for instance a teardrop shape as shown in FIGS. 1 and 3, a circular surface for the insertion of a drinking straw, or a full tear-open surface the shape of which coincides with the full surface of the lid. Additionally, the lid may also have a second tear-open part, which serves to provide a ventilation opening.

The weakening line 21 is embodied in the carrier layer 14 of the lid 11 as a notch 22, which either entirely or almost entirely perforates the carrier layer 14. The notch 22 is preferably formed by melting and positively displacing the plastic of the carrier layer 14 in the vicinity of the weakening line 21 by means of a heated notching tool.

Figure 2:
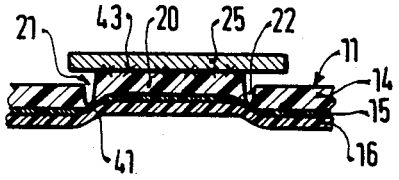
FIG. 2. shows a part of the container lid of FIG. 1 in a cross section taken in the plane II—II of FIG. 1.

In order to decrease the resistance offered when beginning to tear the tear-open part 20, the inner, metallic barrier layer 15 is also weakened, coinciding in location with the notch 22, in the starting segment 27, which in the illustrated embodiments is provided at the narrow end of the teardrop-shaped tear-open part 20. The weakening of the barrier layer 15 in the exemplary embodiment shown in FIG. 2 is embodied as a thinned area 41 of the barrier layer 15 in the starting segment 27, formed by stretching. A thinned area 41 of this kind, coinciding with the notch 22, is effected by means of displacement or offsetting of the tear-open part 20 relative to the adjacent portion of the lid 11 crosswise to the plane of the lid, by means of a stamp. The displacement distance is dimensioned such that the metal barrier layer 15 is plastically stretched, and locally broken while the adjoining sealing layer 16 is stretched in the elastic or plastic range but not allowed to break. A weakening of the barrier layer 15 can also be attained by pressing, for instance upon notching the carrier layer, by means of a non-flat tool or by means of an underlay of varying hardness.

Figure 4:
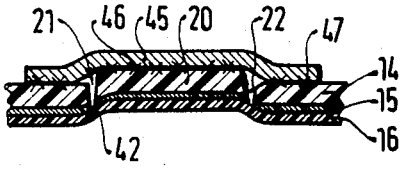
FIG. 4 shows a part of the container lid of FIG. 3 in a cross section taken in the plane IV—IV of FIG. 3.

If the tear-open part 20 is offset relative to the remaining portion of the lid 11 by a greater dimension, and in fact so far that the plastic stretching range of the metal barrier layer 15 is exceeded, then the barrier layer 15 ruptures in a location coincident with the notch 22, while contrarily the more-elastic sealing layer 16 made of plastic continues to stretch, this is because aluminum has a 7% elongation before rupturing whereas PE has a 500% elongation before rupturing. After the stamp has been removed, the tensions built up in the sealing layer 16 partially retract the tear-open part 20 once again, but the rupture 42 of the metal barrier layer 15 remains, as is shown in the exemplary embodiment of FIG. 4. In the manner described, the barrier layer 15 may be weakened or ruptured not only in the starting segment 27 of the tear-open part 20, but also in the entire length of the notch 22. In order to re-close the rupture gap 42 of the barrier layer 15 as far as possible, so that the lid retains a highly tight seal, the offset tear-open part 20 can be displaced back into the plane of the surface of the lid, so that the flanks of the rupture 42 rest against one another.

To tear out the tear-open part 20 from the lid 11, a grip tab 25 is provided in the starting segment 27 thereof. Preferably the grip tab is heat sealed, welded or glued to the outer carrier layer 14 of the tear-open part 20 at the point marked 43. In the exemplary embodiment according to FIGS. 3 and 4, the grip tab 45, which is of some thermoplastic material or a plastic-metal laminate, covers the tear-open part 20 and is connected outside the notch 22 with the upper surface of the carrier layer 14 of the lid 11 by means of a self-contained sealing seam 47. A grip tab 45 thus sealed on, outside the notch 22, in a narrow contour on the upper surface of the lid compensates for the loss in gas-tightness in the vicinity of the rupture 42 of the barrier layer 15. The strength of the sealing seam 47 is set to be less than that of the connection 46 between the grip tab 45 and the tear-open part 20. The different strengths of the seals 46 and 47, is attained by means of the selection of various sealing parameters such as temperature, pressure, time or physical change in the surface of the lid 11 and/or grip tab 45 inside or outside the weakening line 21, for instance by means of local, limited application of heat-sealing means with an effect that increases or weakens the bond. Thus an easy peeling off of the grip tab 45 from the lid 11 outside the tear-open part 20 and a firm connection between the grip tab 45 and the starting segment 27 of the tear-open part 20 are attained.

The above description indicates a compound material having three layers for the production of a lid according to the invention. The use of compound materials with some other structure is also possible within the scope of the invention.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A container lid comprising an outer, relatively thick carrier layer of a thermoplastic material, an inner sealing layer made of a thermoplastic material and adapted to be heat sealed to a container body, a middle barrier layer preferably comprising a thin metal foil, a weakened line stamped into the carrier layer and surrounding a tear-open part, wherein said barrier layer is weakened along a line coinciding in location with said weakened line in the carrier layer, at least in the area in which the tear is iniatially started.

2. A container lid as defined by claim 1, in which the barrier layer is thinned in the area of the weakening line by means of stretching or pressing.

3. A container lid as defined by claim 1, in which the barrier layer is ruptured in the area of the weakening line.

4. A container lid as defined by claim 1, in which a grip tab connected with the tear-open part covers the tear-open part and is releasably sealed by means of a sealing seam with the portion of a lid outside the tear-open part.

5. A container lid as defined by claim 2, in which a grip tab connected with the tear-open part covers the tear-open part and is releasably sealed by means of a sealing seam with the portion of a lid outside the tear-open part.

6. A container lid as defined by claim 3, in which a grip tab connected with the tear-open part covers the tear-open part and is releasably sealed by means of a sealing seam with the portion of a lid outside the tear-open part.

7. A container lid as defined by claim 4, in which the strength of the sealing seam is less than the strength of the connection between the grip tab and the tear-open part.

8. A container lid as defined by claim 5, in which the strength of the sealing seam is less than the strength of the connection between the grip tab and the tear-open part.

9. A container lid as defined by claim 6, in which the strength of the sealing seam is less than the strength of the connection between the grip tab and the tear-open part.

10. A container lid as defined by claim 1, in which the tear-open part is offset relative to the remaining lid portion crosswise to the plane of the lid.

11. A container lid as defined by claim 2, in which the tear-open part is offset relative to the remaining lid portion crosswise to the plane of the lid.

12. A container lid as defined by claim 3, in which the tear-open part is offset relative to the remaining lid portion crosswise to the plane of the lid.

13. A method of forming a tear-open part in a three layer lid of a container comprising an outer layer, a barrier layer and an inner layer, which comprises:

forming a notch in the surface of the outer layer of said lid which notch forms an outline of an opening to be made in said lid, weakening said barrier layer along a line coinciding with said notch formed in said outer layer, and applying a grip top to said outer layer along said notch in said outer layer.

14. A method as set forth in claim 13 which includes:

heating said outer layer to melt a portion of said outer layer in order to form said notch therein.

15. A method as set forth in claim 13 which includes:

stretching said barrier layer in the area coinciding with said notch in said outer layer to produce a thinned area coinciding with said notch.

16. A method as set forth in claim 14 which includes:

stretching said barrier layer in the area coinciding with said notch in said outer layer to produce a thinned area coinciding with said notch.

17. A method as set forth in claim 13 which includes:

rupturing said barrier layer in the area coinciding with said notch formed in said outer layer.

18. A method as set forth in claim 14 which includes:

rupturing said barrier layer in the area coinciding with said notch formed in said outer layer.

* * * * *